United States Patent [19]

Miyazaki et al.

[11] 4,149,678

[45] Apr. 17, 1979

[54] OPEN-END SPINNING MACHINE

[75] Inventors: Tsutomu Miyazaki, Kariya; Yoshiaki Yoshida, Obu; Kinpei Mitsuya, Aichi; Takeshi Ogasawara, Gamagori, all of Japan

[73] Assignee: Kabushiki Kaisha Toyoda Jidoshokki Seisakusho, Aichi, Japan

[21] Appl. No.: 778,147

[22] Filed: Mar. 16, 1977

[30] Foreign Application Priority Data

Mar. 23, 1976 [JP] Japan ..... 51-32338
Mar. 26, 1976 [JP] Japan ..... 51-33881

[51] Int. Cl.[2] ..... B65H 54/20; B65H 59/12

[52] U.S. Cl. ..... 242/35.5 R; 242/18 R; 242/18 DD; 242/43 R; 242/45; 242/147 R

[58] Field of Search ..... 242/35.5 R, 18 DD, 18 R, 242/18 PW, 43 R, 45, 147 R, 153, 154

[56] References Cited

U.S. PATENT DOCUMENTS

| | | | |
|---|---|---|---|
| 3,359,715 | 12/1967 | MacKie | 242/43 R X |
| 3,921,921 | 11/1975 | Katayama et al. | 242/18 PW X |
| 4,060,207 | 11/1977 | Miyazaki et al. | 242/18 R |

FOREIGN PATENT DOCUMENTS

| | | | |
|---|---|---|---|
| 2202511 | 5/1974 | France | 242/45 |
| 22493 of | 1905 | United Kingdom | 242/147 R |
| 18176 of | 1915 | United Kingdom | 242/147 R |
| 217659 | 6/1924 | United Kingdom | 242/45 |
| 434747 | 9/1935 | United Kingdom | 242/18 DD |
| 472157 | 9/1937 | United Kingdom | 242/147 R |

*Primary Examiner*—Stanley N. Gilreath
*Attorney, Agent, or Firm*—Burgess, Ryan and Wayne

[57] ABSTRACT

Disclosed is an open-end spinning machine which comprises a feed roller and a top roller for positively feeding a spun yarn from a spinning unit, a traverse guide for traversing the spun yarn in a direction perpendicular to the spun yarn feeding direction, a winding drum for frictionally rotating a conical surface bobbin for winding the traversed yarn to form a conical cheese, a guide or guides for absorbing yarn path length variations caused by the traverse motion of the spun yarn and by the conical angle of the conical cheese during the winding operation, a device for adjusting the guide in response to the conical angle of the conical cheese. By utilizing this machine, a good-shaped conical cheese of an open-end spun yarn having a uniform hardness along the axial direction of the cheese is obtained. Furthermore, this machine can be utilized for winding of various cheeses having various conical angles.

12 Claims, 26 Drawing Figures

Fig. 11
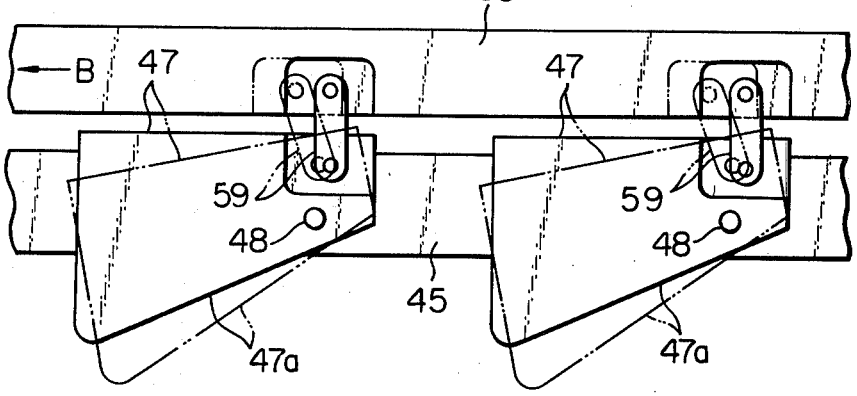
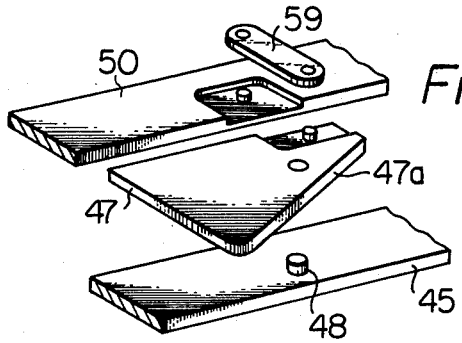
Fig. 12
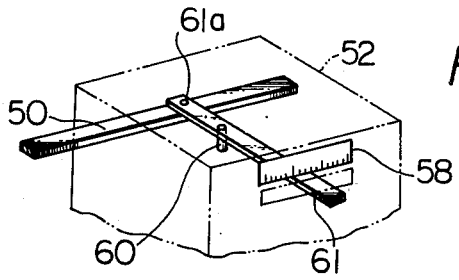
Fig. 13

OPEN-END SPINNING MACHINE

DETAILED DESCRIPTION OF THE INVENTION

This invention relates to an open-end spinning machine, especially an open-end spinning machine having a device for absorbing yarn path length variations during a winding operation.

It is usual in a conventional open-end spinning machine for a spun yarn, which is positively fed from a spinning unit by a feed roller and a top roller and which is passing through a guide bar, to be traversed to and fro by a traverse guide and then wound around a conical surface bobbin frictionally driven by a winding drum to form a conical cheese.

However, in the above-mentioned conventional open-end spinning machine, when the spun yarn is traversed and wound around a concical bobbin, the spun yarn is exposed to different variations of yarn tension, which create difficulties during the winding of a conical cheese on an open-end spinning machine.

The first yarn tension variation is caused by a yarn length variation generated in the traverse motion of the yarn during the winding operation. As the angle formed by the traversing yarn against the central yarn path of the traverse motion increases, the tension generated in the traversing yarn increases.

The second yarn tension variation is caused by a variation in the circumferential length of the conical cheese along the axis of the cheese; the latter variation is generated by the conical shape of the cheese defined by a predetermined conical angle between the axis and the surface of the cheese. When the yarn is traversing from the bottom portion of the conical cheese to the top portion of the conical cheese, the tension generated in the spun yarn is decreased.

The third yarn tension variation is caused by a variation in the driving portion of the winding drum according to the changes of the contacting conditions between the driving surface of the winding drum and the driven surface of the conical cheese. The driving portion varies irregularly, over the surface of the conical cheese because the circumferential length changes as the yarn traverses, and because the contact pressure between the surfaces of the elastic conical cheese and the winding drum changes during the winding operation.

The fourth tension variation is caused by a traversing time lag generated by the drag force between the spun yarn and the guide bar during the traversing operation. Because the time lag of the spun yarn depends on the frictional coefficient of the surface of the guide bar and on the spun yarn conditions, the time lag changes irregularly.

The fifth tension variation is caused by a change of slippage between the winding drum and the conical cheese. This change of slippage is first caused by an increase in the weight of the conical cheese during the winding operation. Furthermore, this slippage has a tendency to decrease as the weight of the conical cheese increases. However, the above-mentioned slippage also depends on the contacting conditions between the winding drum and the conical cheese. As a result, the slippage changes irregularly during the winding operation.

As mentioned above, in the conventional open-end spinning machine, the spun yarn is exposed to different variations of the yarn tension during the winding operation. Therefore, the shape of the wound package of the conical cheese is deformed, especially the side ends thereof are deformed. In addition, the obtained conical cheese has a surface containing uneven hardnesses along the axial direction thereof. In the subsequent process, it is very difficult to withdraw the spun yarn from such a deformed conical cheese having uneven hardnesses on its surface. The deformed conical cheese thus causes such defects to occur as yarn entanglements, yarn breakages and low productivity during the subsequent process.

In an open-end spinning machine, a spun yarn is positively fed from a spinning unit by way of a feed roller and a top roller. The spinning unit has a uniformly rotating rotor mounted therein. Accordingly, the feed roller and the top roller are disposed at a position downstream of the spinning unit. The reason why the spun yarn must be positively fed is that it is necessary to maintain the feeding speed of the spun yarn at a certain constant speed for obtaining a uniformly twisted yarn. In addition, a positively fed spun yarn has little tendency to absorb the yarn path length variations caused at a position downstream of the feed and top rollers. As a result, in an open-end spinning machine, the spun yarn is strongly influenced by the above-mentioned yarn path length variations, thereby causing the above-mentioned defects.

To eliminate the above-mentioned defects, the inventors of the present invention examined tension variations under various winding conditions and confirmed that the occurrences of the above-mentioned defects are mostly brought about by the first tension variation caused by the traversing motion of the yarn and by the second tension variation caused by the conical angle of the conical cheese. The present invention was achieved by utilizing the results obtained from the above-mentioned examination.

An object of the present invention is to provide an open-end spinning machine having a device for absorbing the yarn path length variations which cause the above-mentioned first and second tension variations and which can form a well-shaped conical cheese having a uniform hardness on the surface thereof along the axial direction of the cheese.

Another object of the present invention is to provide an open-end spinning machine which has a device for adjusting the above-mentioned absorbing device in response to the conical angle of the conical cheese. Accordingly, this machine can be utilized under various conical angle conditions.

A further object of the present invention is to provide an open-end spinning machine which has a device for simultaneously adjusting each absorbing device of the machine frame by a one-step process.

Other objects of the present invention will be apparent from the following description and from the attached drawings.

The present invention is an open-end spinning machine which comprises means for feeding a spun yarn from a spinning unit, means for traversing the fed spun yarn in a direction perpendicular to the feeding direction of the spun yarn, a winding drum for frictionally rotating a bobbin having a conical surface for winding the traversed yarn to form a conical cheese, means for absorbing yarn path length variations caused by the traverse motion of the spun yarn and by the conical angle of the conical cheese during winding on the bobbin, such absorbing means being disposed at a position which is adjacent to said spun yarn path between the feeding means and the winding drum, and means for adjusting the absorbing means in response to the conical angle of the conical cheese.

The absorbing means of the present invention may be a guide having a guide surface, wherein the guide surface extends substantially along the axial direction of the winding drum and inclines against the axis of the winding drum, and wherein the angle of inclination between the guide surface and the axis of the winding drum is variable.

The absorbing means may comprise a plurality of guide surfaces extending along the axial direction of the winding drum and inclining against the axis of the winding drum, wherein each angle of inclination between each guide surface and the axis of the winding drum is determined by each conical angle of the conical cheese, and wherein the adjusting means is adjusted to one of the guide surfaces so that the selected guide surface is adjusted to the predetermined angle of the conical cheese.

The adjusting means may include a common longitudinal member extending along a longitudinal direction of the machine frame, wherein the member has an absorbing means mounted thereon at positions corresponding to each spindle of the machine frame. By adjusting the adjusting means, each spindle is adjusted to a predetermined angle of the conical cheese.

BRIEF DESCRIPTION OF THE DRAWINGS

FIG. 11 is an enlarged partial plan view illustrating the second embodiment of the present invention;

FIG. 12 is an enlarged partial perspective view of the embodiment shown in FIG. 11;

FIGS. 13 and 14 are partial perspective views of the second embodiment of the present invention;

The yarn tension variation caused by the yarn path length variations generated by the traverse motion of the spun yarn is hereinafter explained in detail with reference to the accompanying FIG. 1 and 2. In a conventional open-end spinning machine as shown in FIG. 1, a spun yarn 24 from a spinning unit 21 is fed from a contacting line "a" formed between a feed roller 22 and a top roller 23 to a contacting line "b" formed between a winding drum 27 and a conical cheese 29 wound on a bobbin 28 via a guide bar 25 and a traverse guide 26 for traversing the spun yarn to and fro. As shown in FIG. 2, the spun yarn is traversed from an end position X to the other end position Z through a central position Y, and has a traverse width T defined as the distance between the positions X and Z. The spun yarn passing by the position X is wound at a bottom portion of the conical cheese 29 having the largest diameter. The yarn runs toward X forming an angle $\theta_o$ with the central line n formed by the spun yarn which is running toward the central position Y. The spun yarn, passing by the position Z is wound at a top portion of the conical cheese 29 having the smallest diameter. Passing by a certain position W having a distance x along the line a, the spun yarn runs a yarn path length $l_1$ from the contacting line "a" to the contacting line "b" forming an angle $\theta$ with the central line having a yarn path length $l_o$.

Figure 2:
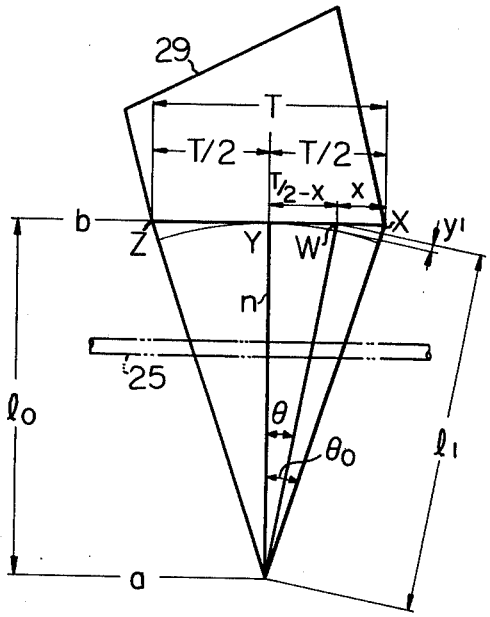
FIG. 2 is a plan view illustrating the traverse motion of a spun yarn shown in FIG. 1.

The yarn path length variation $y_1$ is defined as:

$$y_1 = l_1 - l_o$$

since it is apparent in FIG. 2 that:

$$l_1 = l_o/\cos\theta$$

therefore, $$y_1 = l_o(1/\cos\theta - 1) \quad (1)$$

wherein $$\theta = \tan^{-1}(1T/2X1/l_o)$$

$$O \leqq x \leqq T$$

As is apparent from equation (1), the yarn path length variation $y_1$ caused by the traverse motion of the spun yarn increases as the above-mehtioned angle $\theta$ between the yarn path and the central line is increased. That means that the yarn path length variation is increased as the winding position is displaced toward the bottom portion X or the top portion Z. The spun yarn running toward the bottom or top portion forming the maximum angle $\theta_o$ causes a yarn path length variation defined by:

$$y_1 = l_o(1/\cos\theta_o - 1)$$

wherein $$\theta_o = \tan^{-1}(T/2l_o)$$

Figure 4:
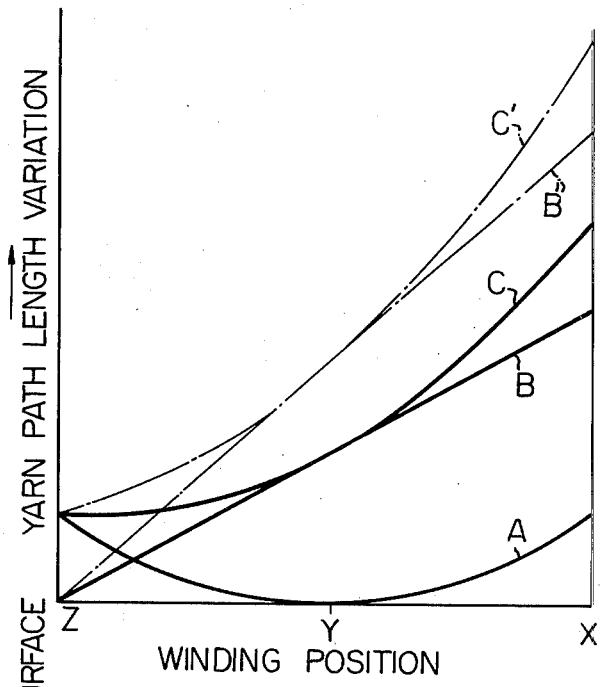
FIG. 4 is a diagram showing the relationship between respective winding positions of the spun yarn and respective yarn path length variations.

The characteristic of the yarn path length variation defined by equation (1) is shown by line A in FIG. 4.

Figure 3:
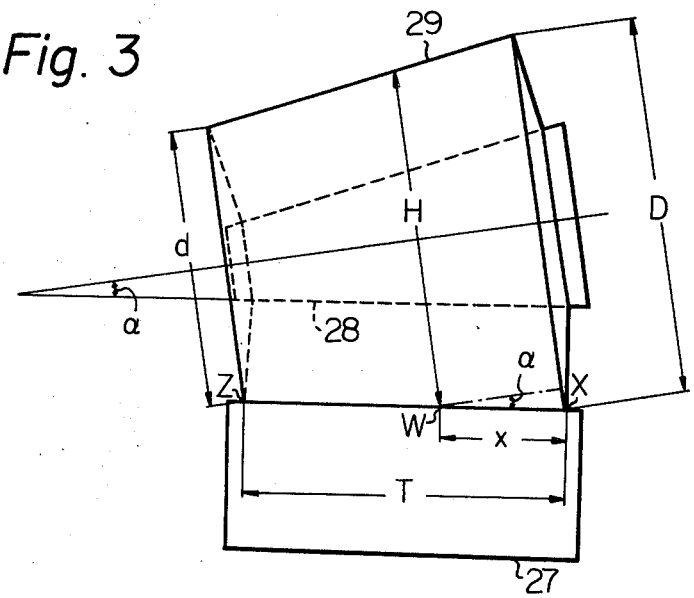
FIG. 3 is a plan view illustrating the winding relationship between a winding drum and a conical cheese wound on a bobbin shown in FIG. 1.

The yarn tension variation caused by the yarn path length variation generated by the conical angle of the conical cheese is hereinafter explained in detail with reference to the accompanying FIG. 3. In a conventional open-end spinning machine, as shown in FIG. 3, the spun yarn is wound on a bobbin 28 exhibiting a conical surface which has a conical angle $\alpha$ and which forms a conical cheese 29. The conical cheese 29 has a conical angle $\alpha$, a bottom portion X which has a diameter D at the largest portion, and a top portion Z which has a diameter d at the smallest portion. The conical cheese has a diameter H at the portion W having a distance x along the line XZ. The yarn path length variation $y_2$ (not shown) caused by the circumferential length is defined as:

$$y_2=\pi H-\pi D$$

as it is apparent in FIG. 3 that:

$$H=D-2 \sin \alpha \cdot x$$

therefore, $$y_2=-2\pi \sin \alpha \cdot x \quad (2)$$

As is apparent from equation (2), the yarn path length variation $y_2$ caused by the circumferential length decreases as the winding position moves toward a top portion from the bottom portion of the conical cheese during the winding operation. The characteristic of the yarn path length variation $y_2$ for a predetermined conical angle $\alpha$ is shown by the solid line B in FIG. 4.

If the conical angle $\alpha$ is varied, for example, if the conical angle $\alpha$ is increased, as it is apparent from equation (2), the yarn path length variation $y_2$ has a larger inclination as shown by the dot-dash line B' in FIG. 4.

It has been found that, in a conventional open-end spinning machine, during the winding operation including the operation of traversing a spun yarn and the operation of forming a conical cheese by winding the spun yarn around a conical bobbin, a yarn tension variation results mostly from the above-mentioned first yarn path length variation $y_1$ caused by the traverse motion of the spun yarn and by the second yarn path length variation $y_2$ caused by the conical angle of the conical cheese. Furthermore, the spun yarn is exposed to both of the above two yarn path length variations at the same time. The sum y of these variations $y_1$ and $y_2$ is shown by the solid line c in FIG. 4.

According to the above-mentioned investigation, the inventors of this invention confirmed that it is possible to decrease the yarn tension variation by providing a guide for absorbing the above-mentioned two kinds of yarn path length variations, and that the absorbing guide should have a guide surface, having a reverse displacement defined as the displacement being sufficient for absorbing the yarn path length variation y, which is the sum of the yarn path length variations $y_1$ and $y_2$, so that the absorbing guide can absorb these two yarn path length variations.

The first yarn path length variation caused by the traverse motion is shown as mentioned above, $$y_1=l_o(1/\cos \theta-1$$

and is also shown by the line A in FIG. 4 as mentioned above. To absorb the yarn path length variation $y_1$, the absorbing guide is needed to have a reverse characteristic $y_1'$. The reverse characteristic $y_1'$ is determined from the difference between the yarn path length variation of the maximum traversed spun yarn which is wound at the bottom portion of the conical cheese 29 and that of a certain position moved a certain distance x toward the top portion Z. Therefore;

$$y_1'=l_o(1/\cos \theta_o-1)-l_o(1/\cos \theta-1)=l_o(1/\cos\theta_o-1/\cos \theta) \quad (3)$$

The second yarn path length variation caused by the conical angle of the conical cheese is defined by equation (2) as mentioned above, $$y_2=-2\pi \sin \alpha \cdot x$$

and is also shown by the solid line B in FIG. 4 as mentioned above. To absorb the yarn length variation $y_2$, the absorbing guide is needed to have a reverse characteristic $y_2'$, $$y_2'=2\pi \sin \alpha \cdot x \quad (4)$$

Figure 5:
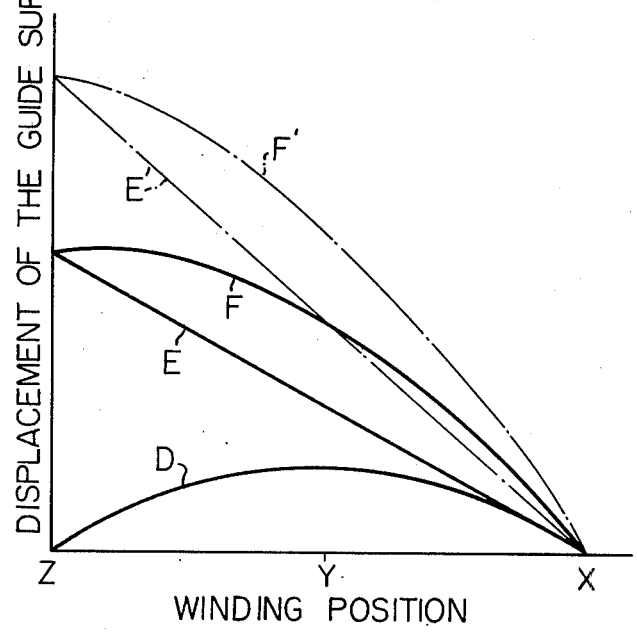
FIG. 5 is a diagram indicating required characteristics of the absorbing means.

In Fig. 5, the displacement for absorbing the first yarn path length variation caused by the traverse motion is shown by the solid line D. Line D has a maximum displacement at the center Y of the traversing motion. The displacement for absorbing the second yarn path length variation caused by the conical angle is shown by the straight solid line E. Line E has an inclination and minimum displacement at the bottom portion X. Consequently, the absorbing guide is needed to have a displacement y', which is the sum of the above-mentioned characteristics $y_1'$ and $y_2'$, for absorbing the first and second yarn path length variations $y_1$ and $y_2$, respectively. Therefore, $$y'=2\pi \sin \alpha x+l_o(1/\cos \theta_o-1/\cos \theta) \quad (5)$$

The characteristic y' is shown by the solid line F in FIG. 5.

As mentioned above, if the conical angle $\alpha$ of the conical cheese is increased from the predetermined angle, the yarn path length variation $y_2$ has a larger inclination as shown by the dot-dash line B' in FIG. 4. Accordingly, the total yarn length variation (y) is obtained by adding the first path length variation $y_1$ to the second yarn path length variation $y_2$. Therefore, the variation y is increased as shown by the dot-dash line C' in FIG. 4. The reverse characteristic is shown by the solid line F in FIG. 5 for a predetermined conical angle $\alpha$. When the conical angle is increased from the above-mentioned predetermined angle $\alpha$ to a certain angle, the reverse characteristic changes to another characteristic shown by the dot-dash line F' in FIG. 5. Therefore, if the predetermined conical angle is changed, it is necessary to change the absorbing guide having a characteristic for absorbing the yarn length variation in response to the conical angle.

In the present invention, an open-end spinning machine is provided with a means for adjusting the absorbing guide in response to the conical angle.

An open-end spinning machine, according to the present invention is explained hereinafter with reference to the accompanying FIGS. 6 and 7. A spinning unit 31 having a rotary roller mounted therein for spinning a sliver into a yarn is provided on a machine frame (not shown). In FIG. 7, a feed roller 32 is disposed at a position above the spinning unit 31. The feed roller 32 is rotatably mounted and connected with a suitable driving source (not shown) so as to be rotated in a direction as shown by the arrow A in FIG. 7. A fixed shaft 33 is disposed at a position above the feed roller 32 arranged in parallel with the axis of the feed roller 32. The fixed shaft 33 has a supporting arm 34 swingably mounted thereon. Each end of the supporting arm 34 is provided with a rotatable top roller 35 which is urged toward the surface of the feed roller 32 so as to be engaged with the surface of the feed roller 32. A spun yarn 36 spun out from the spinning unit 31 is nipped between the feed roller 32 and the top roller 35, and is positively fed upwardly via the feed roller 32 and the top roller 35.

A common traverse rod 37 is provided on the machine frame to be movable in an axial direction of the rod 37 at a position above the engaging position of the feed roller 32 and the top roller 35. A traverse guide 38 for engaging and traversing the spun yarn 36 is fixed onto the traverse rod 37. A common rotary shaft 39 is rotatably mounted in parallel with the feed roller 32 at a position above the feed roller 32. The rotary shaft 39 is connected with a suitable driving source (not shown) and is positively driven in the direction as shown by the arrow C in FIG. 7. The rotary shaft 39 has a plurality of winding drums 40 fixedly mounted thereon. A pair of cradles 41 is swingably disposed at a position in front of an upper portion of the machine frame. This pair of cradles is provided with a pair of rotary bobbin holders 42, and the pair of cradles is detachably mounted with a conical surface bobbin 43. The bobbin 43 engages with the surface of the winding drum 40 and is rotated in the direction as shown by the arrow E in FIG. 7.

The spun yarn 36 fed upwardly via the feed roller 32 and the top roller 35 is traversed to and fro by way of the traverse guide 38. Then the spun yarn 36 is fed to the winding drum 40 to form a conical cheese 44 around the bobbin 43 rotated by the winding drum 40.

At a position adjacent to the spun yarn path between the feed roller 32 and the winding drum 40, a device for absorbing yarn path length variations is disposed for absorbing yarn tension variations caused by the yarn path length variations during the winding operation.

The first embodiment of the device for absorbing yarn path length variations is explained hereinafter with reference to the accompanying FIGS. 6 through 10. A common supporting plate 45 is extended along a machine frame (not shown) at a position beneath and in front of the traverse rod 37. The supporting plate 45 is provided with a vertically penetrating slit 46. The slit 46 extends along the longitudinal direction of the supporting plate 45 (in FIG. 9). A yarn path length variation absorbing plate guide 47 is pivotally mounted on a pin 48 on the upper surface of the supporting plate 45 at a position in front of both the winding drum 40 and the conical cheese 44. The yarn path length variation absorbing plate guide 47 is provided with a guide surface **47*a* at the front side thereof. The guide surface 47*a* has a displacement defined by the above-mentioned equation (5). When the yarn path length variation absorbing plate guide 47 is turned around the pin 48, the guide surface 47*a*** is adjusted to the required angle of inclination.

Therefore, this embodiment can respond to any changes of the conical angle $\alpha$ by way of adjusting the yarn path length absorbing plate guide 47 to the desired angle of inclination.

For example, if the conical angle $\alpha$ is changed to an angle which is larger than the predetermined angle, the yarn path length variation absorbing plate guide 47 can be turned toward the front side to adjust the guide surface **47*a*** to the desired angle of inclination having a displacement as shown in FIG. 5.

Figure 7:
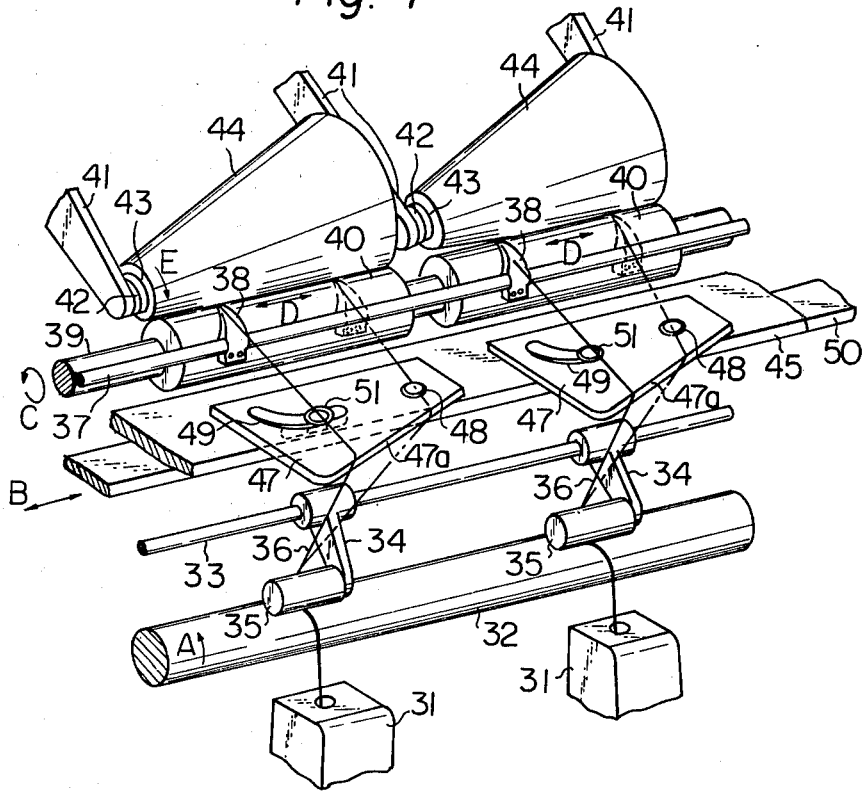
FIG. 7 is an enlarged perspective view of the embodiment shown in FIG. 6.
Figure 8:
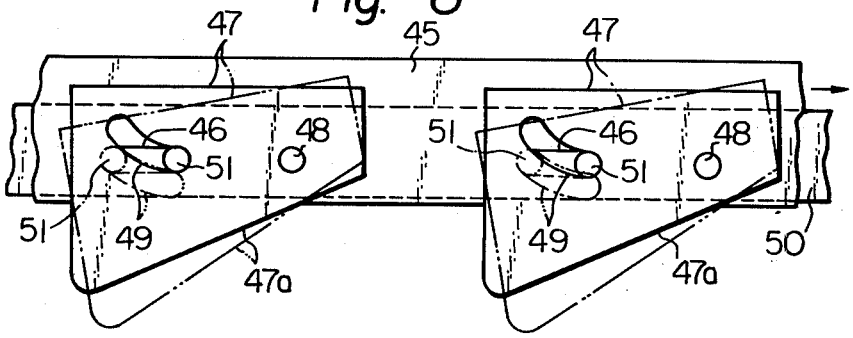
FIG. 8 is an enlarged partial plan view of the embodiment shown in FIG. 6.
Figure 9:
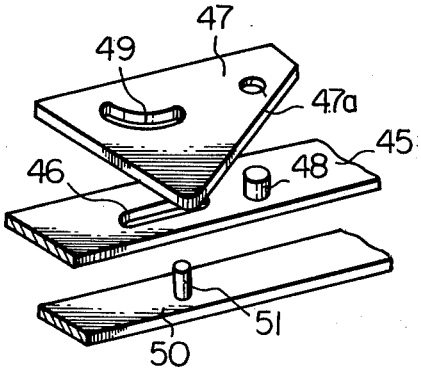
FIGS. 9 and 10 are enlarged partial perspective views of the embodiment shown in FIG. 6.
Figure 10:
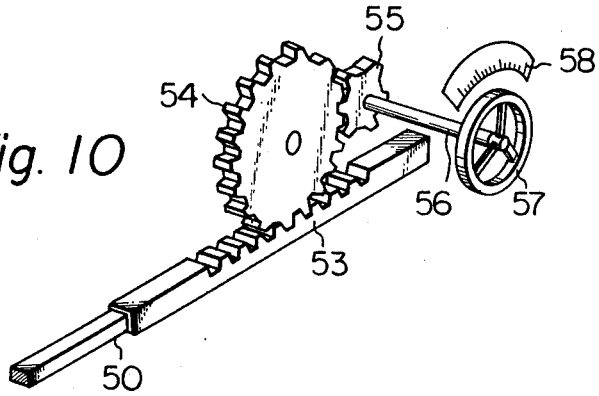

As shown in FIGS. 7, 8 and 9, an arc-shaped vertically penetrating slit 49 is formed on the yarn path length variation absorbing plate guide 47 at a position corresponding to the slit 46 disposed on the supporting plate 45. A common working plate 50 is disposed to be movable to and fro along the longitudinal direction of the machine frame at a position just below the supporting plate 45. A working pin 51 penetrating through both slits 46 and 49 is provided for each spindle on an upper surface of the working plate 50 at a position corresponding to both the slit 46 of the supporting plate 45 and the slit 49 of the yarn path length variation absorbing plate guide 47. The working pin 51 is movable within both slits 46 and 49. When the supporting plate 45 is moved along the slit 46 provided on the supporting plate 45, the yarn path length absorbing plate guide 47 is swung around the pin 48 so as to adjust the guide surface **47*a*** to a desired displacement.

Figure 6:
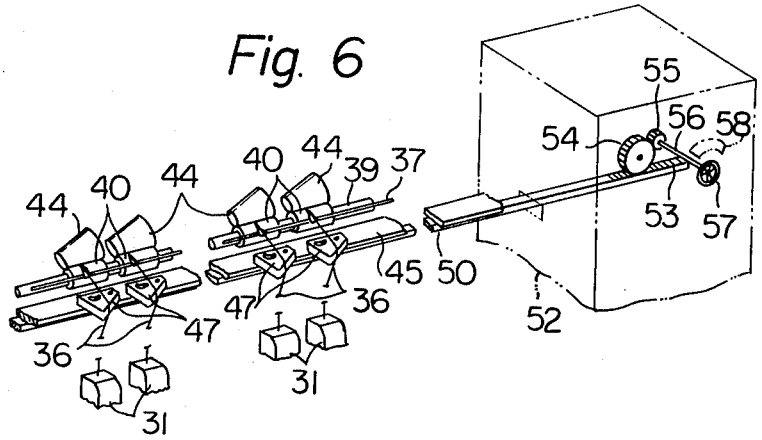
FIG. 6 is a perspective view illustrating the first embodiment of the present invention.

In FIG. 6, one end of the working plate 50 is inserted into a working box 52 disposed in front of the machine frame. This end of the plate 50 is provided with a rack 53 which is engaged with a driven gear 54. The driven gear 54 meshes with a driving gear 55. A working shaft 56, on which the driving gear is provided, projects from the front surface of the working box 52. The working shaft 56 is provided with a working wheel 57 at the front end thereof. Graduations 58 for indicating angles of inclination of the yarn path length variation absorbing plate guide 47 determined by way of turning the working wheel 57 are designated at a position located in front of the working box 52 and behind the working wheel 57.

When it is desired to change the guide surface **47*a* of the yarn path length variation plate guide 47 to a certain predetermined angle corresponding to the angle $\alpha$ of the conical cheese 44 which is larger than the predetermined angle, before the conical cheese 44 winding is started, the working wheel 57 is turned in a clockwise direction to a predetermined angle indicated by the graduations 58. Thereafter, the working plate 50 is moved a predetermined distance toward the working box 52 (in the right-hand direction of FIG. 6) via the working wheel 57, the working shaft 56, the driving gear 55, the driven gear 54 and the rack 53. Consequently, each pin 51 (FIG. 7) moves a predetermined distance within the slit 49 (FIG. 7) of the yarn path length variation absorbing plate guide 47 in a horizontal direction as shown by the arrow in FIG. 8, and swings the yarn path length variation absorbing plate guide 47 until the guide surface 47*a* reaches the desired angle of inclination which makes it possible for the guide surface 47*a* to absorb the yarn path length variation caused by the winding operation of the conical cheese 44 (FIG. 6**).

The second embodiment through the ninth embodiment according to the present invention are explained below in detail with reference to the accompanying FIGS. 11 through 26. In these embodiments, the same parts as those illustrated in the first embodiment are shown by the same reference numerals.

The second embodiment is first explained with specific reference to FIGS. 11 and 12. In this embodiment, a working plate 50 is provided at a position just behind a supporting plate 45 which is arranged in parallel with the working plate 50. A yarn path length variation absorbing plate guide 47 is pivotably mounted on the supporting plate 45 with a pin 48. An end of the yarn path length variation absorbing plate guide 47 is connected to the working plate 50 with a connecting link 59. Consequently, when the working plate 50 is moved in the direction of arrow B as shown in FIG. 11, the yarn path length variation absorbing plate guide 47 is turned in a counterclockwise direction, and vice versa.

In the above-mentioned first and second embodiments, it is necessary to provide a mechanism for displacing the working plate 50 in the horizontal direction for adjusting the yarn path length variation absorbing plate guide 47. Such a mechanism which comprises a rotatable working wheel 57, a working shaft 56 rotated by the working wheel 57, driving gear 55 mounted on the shaft 56, a driven gear 54 meshing with the driving gear 55 and driven by the gear 55, and a rack 53 provided on a working plate 50 and meshing with the driven gear 54 is illustrated in the first embodiment in FIG. 6. However, such mechanisms as those respectively described below may also be utilized.

In FIG. 13, a working lever 61 is pivotably mounted at the central portion thereof with a pin 60 in a working box 52. A swingable pin journal 61*a* is provided on the bottom end of the working lever 61. The top end of the working lever projects from the front cover of the working box 52. When the top end of the working lever 61 is moved to and fro, the working plate 50 moves in the opposite direction.

Figure 14:
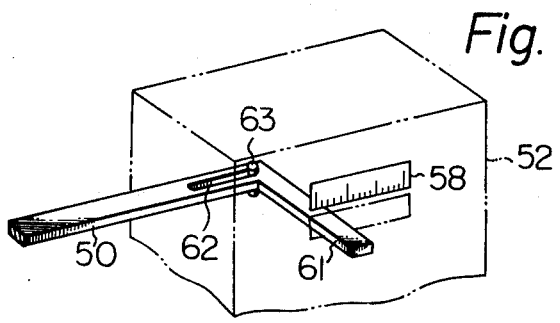

In FIG. 14, a working lever 50 is provided with a slit 62 extending along an end in a longitudinal direction thereof. The end of the working lever 50 is formed in an L-shape, and the top end of the L-shaped lever projects from the front cover of the working box 52. At the end of the L-shaped lever is a working lever 61. A fixed pin 63 is inserted into the slit 62 for guiding the slit 62. Consequently, when the working lever 61 is moved to and fro, the working plate 50 is moved in the same direction.

Figure 15:
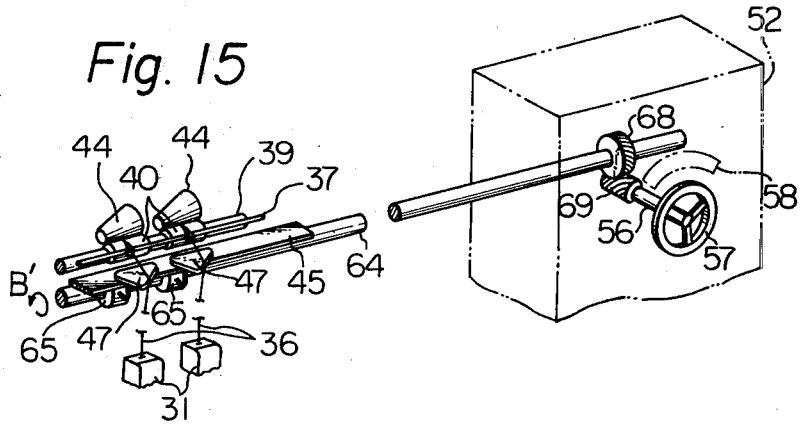
FIG. 15 is a perspective view illustrating the third embodiment of the present invention.
Figure 16:
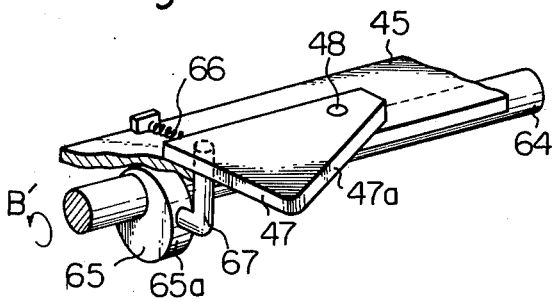
FIG. 16 is a partial perspective view of the embodiment shown in FIG. 15.

The third embodiment of the present invention is hereinafter explained in detail with reference to the accompanying FIGS. 15 and 16. Instead of the working plate 50 in the first embodiment, a rotatable shaft 64 is provided at a position just below a supporting plate 45 which is arranged in parallel with the rotatable shaft 64. An adjusting cam 65 is fixed on the rotatable shaft 64 for each spindle. An end of a yarn path length variation absorbing plate guide 47 is pivotably mounted on the surrporting plate 45 with a pin 48.

Another end of the yarn path length variation absorbing plate guide 47 is always urged backward by means of a spring 66 connected with the guide 47 and the plate 45. An end of a cam follower 67 formed in an L-shape is fixed to the guide 47, and the other end of the cam follower 67 is engaged with the cam surface 65*a* of the adjusting cam 65. Consequently, when the adjusting cam 65 is rotated in the direction as shown by arrow B' in FIGS. 15 and 16, the cam follower 67 will then follow the cam surface 65*a* in such a way that the yarn path length variation absorbing plate guide 47 is swung around the pin 48 against the urging force of the spring 66. An end of the rotatable shaft 64 projects into a working box 52 and has a worm wheel 68 mounted thereon. A working shaft 56 which is perpendicular to the shaft 64 has a worm 69 meshing with the worm wheel 68 and a working wheel 57 mounted thereon.

When the conical angle of the conical cheese 54 is changed to a certain angle from a predetermined angle, before the winding of the conical cheese is started, the working wheel 57 is turned in a clockwise direction to a predetermined graduation 58. Then the adjusting cam 65 is turned a certain angle in the direction as shown by the arrow B' in FIGS. 15 and 16 via the working shaft 56, the worm 69, the worm wheel 68 and the rotatable shaft 64. The cam follower 67 is caused to move forward via the cam surface 65*a* of the adjusting cam 65. Then the yarn path length variation absorbing plate guide 47 is swung against the urging force of the spring 66.

Figure 17:
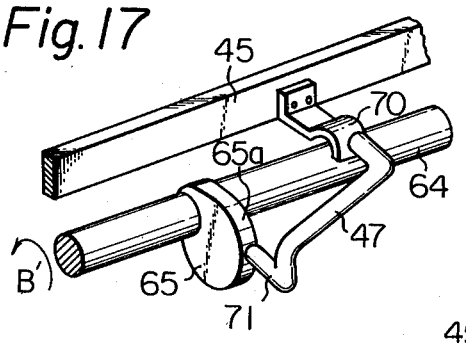
FIGS. 17 and 18 are partial perspective views illustrating the fourth and the fifth embodiments of the present invention, respectively.

The fourth embodiment of the present invention is explained below with reference of the accompanying FIG. 17. In this embodiment, a yarn path length variation absorbing plate guide 47 is a C-shaped bar. This guide 47 has a sufficient degree of elasticity. A bottom end of the guide 47 is fixed to a supporting plate 45, via a bracket 70, and a top end of the guide 47 forms a cam follower portion 71. The cam follower portion 71 is urged toward a cam surface 65*a* of a cam 65. Consesquently, the yarn path length variation absorbing plate guide 47 follows the rotated cam 65 so that the guide 47 is adjusted to a predetermined angle of inclination.

Figure 18:
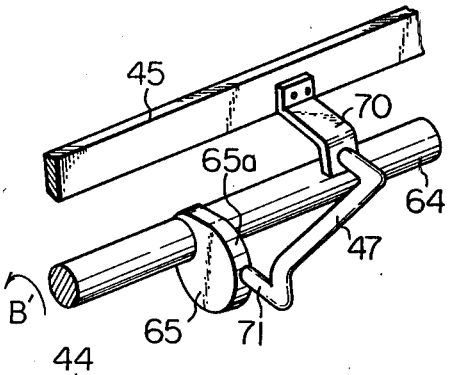

The fifth embodiment of the present invention is explained below with reference to FIG. 18. The mechanism of this embodiment is the same as that shown in FIG. 17 except that, according to the embodiment shown in FIG. 18, the yarn path length variation absorbing plate guide 47 is less elastic and the bracket 70 is more elastic.

Figure 19:
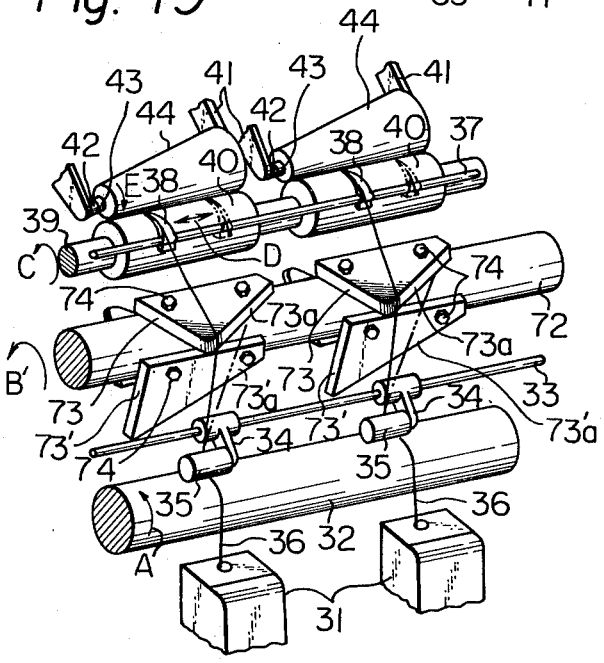
FIG. 19 is a perspective view illustrating the sixth embodiment of the present invetion.
Figure 20:
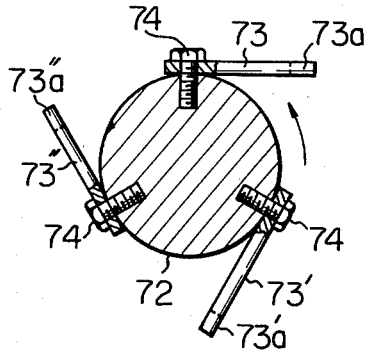
FIG. 20 is a cross-sectional partial side view of the embodiment shown in FIG. 19.

The sixth and seventh embodiments of the present invention are explained below with reference to FIGS. 19 through 21.

A common rotatable shaft 72 is rotatably mounted in parallel with a traverse rod 37 at a position below and in front of the traverse rod 37. A plurality of yarn path length variation absorbing plate guide 73, 73' (in FIGS. 19 through 21, three guides are guide surface shown) having various guide surfaces 73*a*, 73'*a* each having an angle of inclination as defined by the above-mentioned equation (5), are disposed around the rotatable shaft 72 with bolts 74, so that the guide surface 73*a* can be arranged adjacent to the spun yarn path. When the rotatable shaft 72 is rotated, each guide surface 73*a* of the machine frame is adjusted at the same time. An end of the rotatable shaft 72 projects into a working box (not shown) disposed in front of the machine frame. The mechanism of the working box (not shown) is the same as that shown in FIG. 15.

Figure 21:
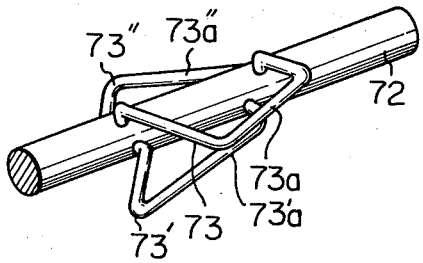
FIG. 21 is a partial perspective view illustrating the seventh embodiment of the present invention.

The yarn path length variation absorbing guide may be formed by a bar as shown in FIG. 21.

Figure 22:
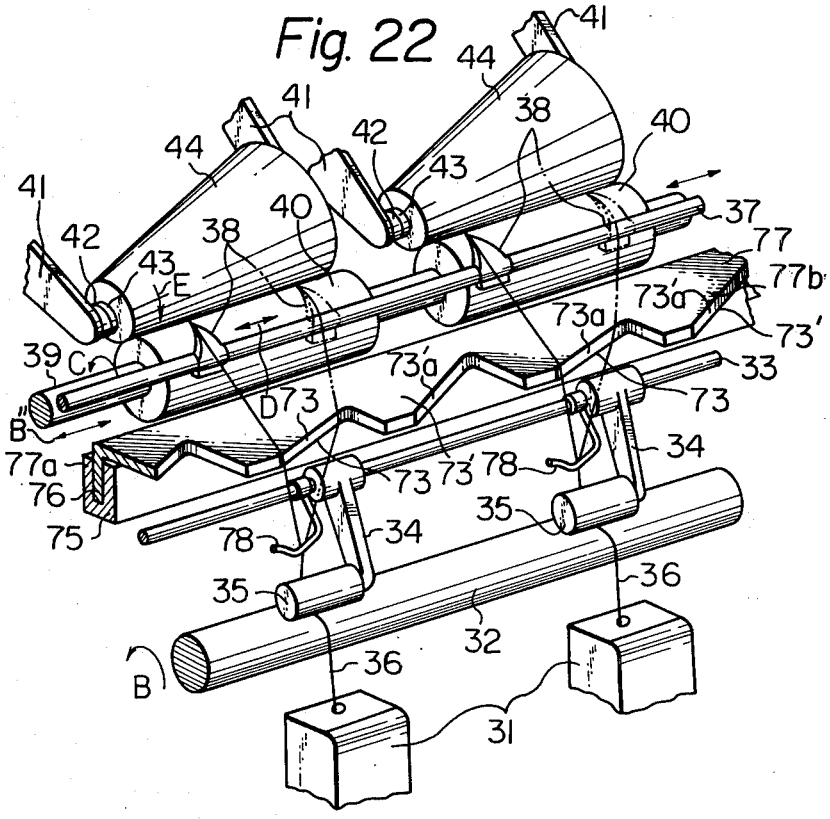
FIG. 22 is a perspective view illustrating the eighth embodiment of the present invention.
Figure 23:
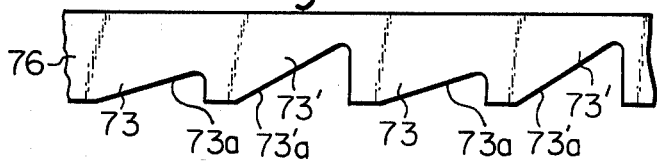
FIG. 23 is a partial plan view of the embodiment shown in FIG. 22.

The eighth embodiment of the present invention is explained hereinafter with reference to FIGS. 22 and 23. In this embodiment, a common guide rail 75 extending along the longitudinal direction of a machine frame (not shown) is fixedly mounted at a position below and in front of a traverse rod 37. A working member 77 has an L-shaped cross section. A vertical edge of the working member 77 is inserted into a groove provided on the guide rail 75 so that the working member 77 can move along the guide rail 75. A horizontal edge of the working member 77 is provided with various yarn path length variation absorbing guides 73, 73' having various displacements. A set of the various guides 73, 73' having various displacements is utilized for each conical cheese 44. An end of the working member 77 projects into a working box (not shown) disposed at a position located in front of the machine frame. The mechanism of the working box (not shown) is similar to one of those shown in FIGS. 10, 13 and 14. An auxiliary guide 78 is swingably provided on a fixed shaft 33 at a position corresponding to a top roller 35 so that the absorbing effects of the yarn path length variation absorbing plate guides 73, 73' are facilitated by the auxiliary guide 78.

When it is desired to situate a yarn path length variation absorbing plate guide 73' instead of the yarn path length variation plate guide 73 at a position located adjacent to a yarn path according to the change of the conical angle of the conical cheese 44, the wheel (not shown) is first rotated, and then the working member (not shown) is rotated via the wheel (not shown), the driving gear (not shown), the driven gear (not shown) and the rack (not shown) as mentioned above.

Figure 1:
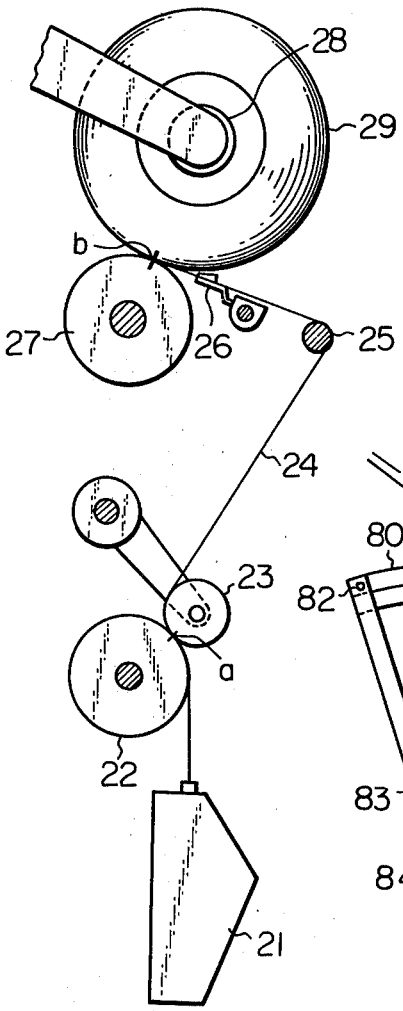
FIG. 1 is a schematic side view of a conventional open-end spinning machine.
Figure 26:
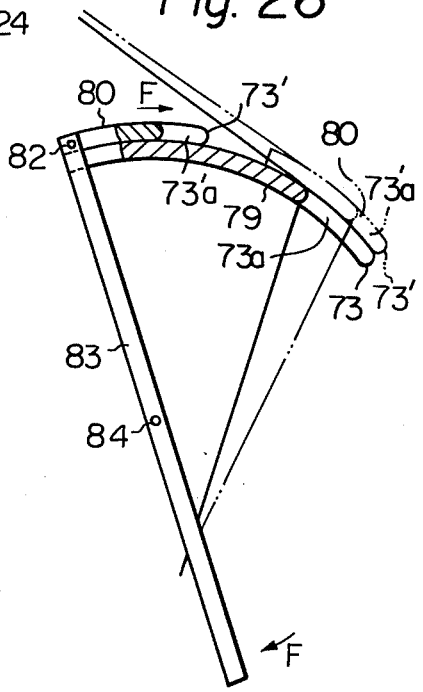
FIG. 26 is a partial side view of the mechanism utilized for the embodiment shown in FIG. 24.
Figure 24:
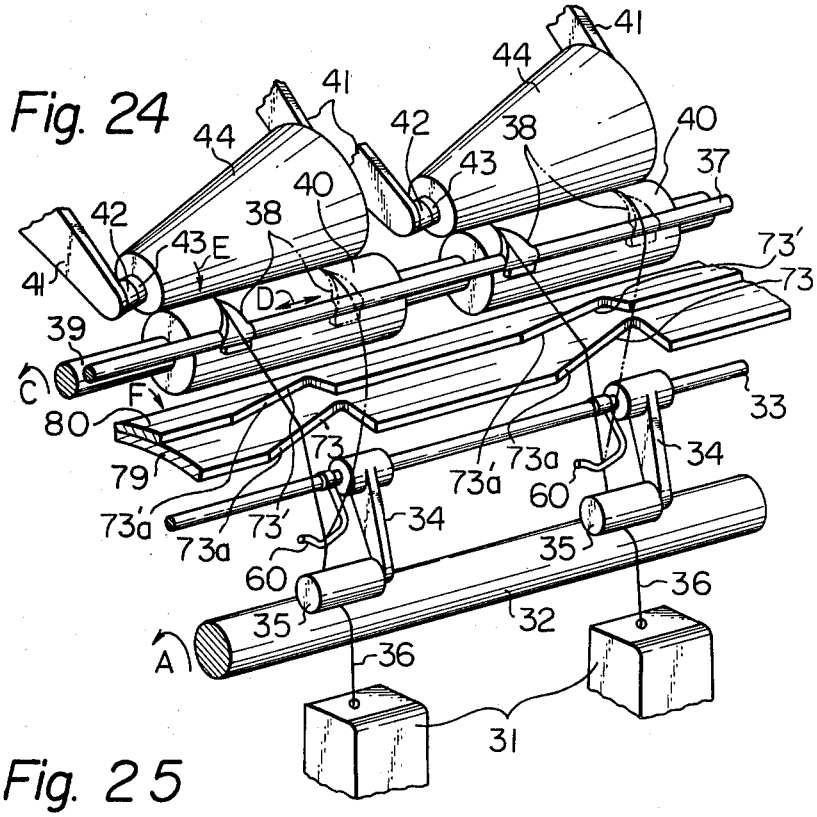
FIG. 24 is a perspective view illustrating the ninth embodiment of the present invention.
Figure 25:
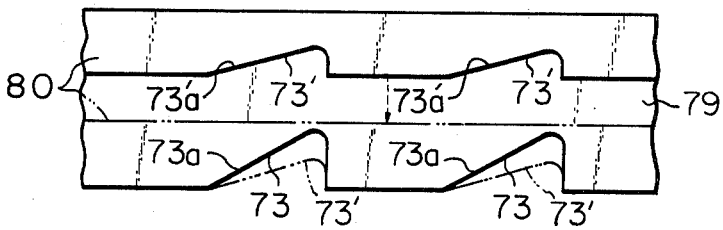
FIG. 25 is a partial plan view of the embodiment shown in FIG. 24.
Figure 7:
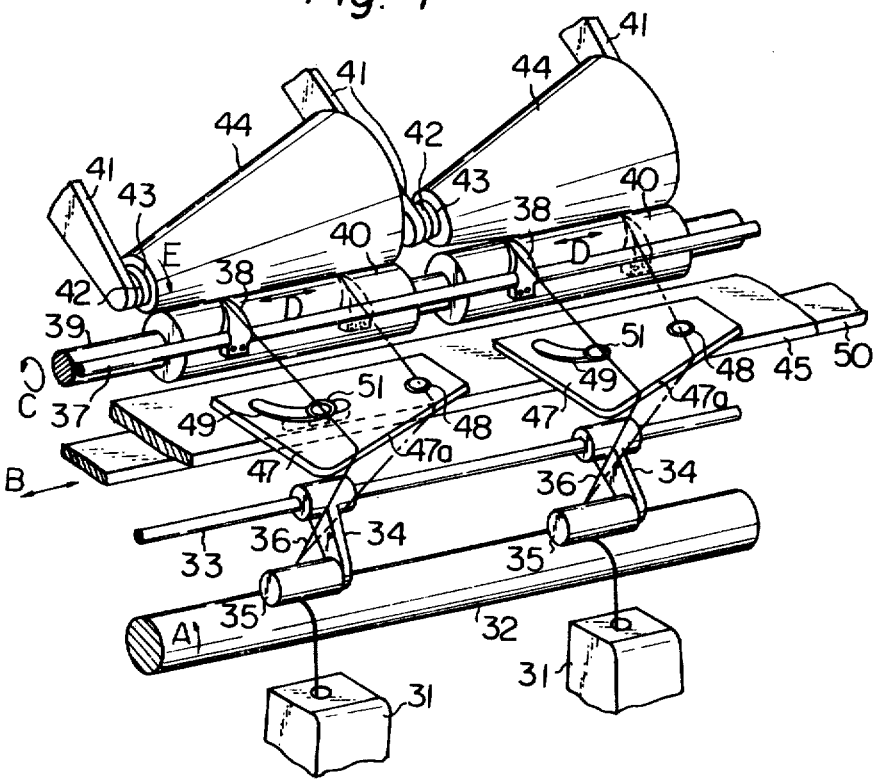

The ninth embodiment of the present invention is explained below with reference to FIGS. 24 through 26. In this embodiment, a common curved plate 79 is fixedly mounted on a machine frame (not shown) at a position below and in front of a traverse rod 37. A yarn path length variation absorbing plate guide 73 having a predetermined displacement is provided at the front portion of the curved plate 79 for each spindle. A common working plate 80 having the same curvature with a width which is less than that of the curved plate 79 is mounted on the curved plate 79 so as to cause the working plate 80 to slide in a transverse direction. The working plate 80 is provided at a front end thereof with another yarn path length variation absorbing guide 73' having a smaller displacement than that of the curved plate 79 for each spindle. When the working plate 80 is moved forward, as the yarn path length variation absorbing plate guide 73' overlaps the yarn path length variation absorbing guide 73 of the curved plate 79, the spun yarn is fed via the guide surface 73'a of the guide 73' to the traverse guide 38. As shown in FIG. 26, the plate 80 is connected to a lever 83 with a pin 82. The lever 83 is pivotably mounted with a pin 84. In this embodiment, two or more working plates which are slidable in a transverse direction may be utilized.

What we claim is:

1. An open-end spinning machine having a plurality of yarn processing units along the lengthwise direction thereof, said machine comprising:

means for positively feeding spun yarns from spinning units, said feeding means being disposed so as to correspond to said yarn processing units, respectively;

means for traversing said fed spun yarns in a direction perpendicular to the feeding direction of said spun yarns, said traversing means being disposed so as to correspond to said yarn processing units, respectively;

winding drums for frictionally rotating bobbins having conical surfaces for winding said traversed yarns to form conical cheeses, said winding drums being disposed so as to correspond to said compensating means disposed adjacent each spun yarn path between said feeding means and said winding drums, respectively, for varying the path lengths of said yarns to compensate for yarn path length variations caused by the traverse motion of said spun yarns and by the conical angle of said conical cheeses during winding on said bobbins;

means for adjusting each of said compensating means in accordance with said conical angle of said conical cheeses, said adjusting means engaging all of said compensating means and extending along the lengthwise direction of said machine; and, means for actuating said adjusting means, said actuating means being disposed at an end of said machine, whereby all of said compensating means of said machine are simultaneously adjusted in accordance with said conical angle of said conical cheeses by means of a one-step process of said actuating means via said adjusting means.

2. An open-end spinning machine according to claim 1, wherein each of said compensating means is a guide having a guide surface, said guide surface extending substantially along the axial direction of each of said winding drums and being inclined with respect to the surface of said each winding drum, the angle of inclination between said guide surface and the surface of said winding drum being variable.

3. An open-end spinning machine according to claim 2, wherein said guide is a C-shaped bar having an end fixed to a supporting member.

4. An open-end spinning machine according to claim 1, wherein each of said compensating means comprises a plurality of guide surfaces extending along the axial direction of a respective winding drum and inclined with respect to the axis of said respective winding drum, and each angle of inclination between each said guide surface and the axis of said respective winding drum is determined by the conical angle of the corresponding conical cheese, said adjusting means being coupled to one of said guide surfaces so that said selected guide surface is adjusted to said predetermined conical angle of said corresponding conical cheese.

5. An open-end spinning machine according to claim 4, wherein said adjusting means is a rod member extending along the axial direction of said winding drum and having a plurality of said guide surfaces disposed around the circumferential surface thereof.

6. An open-end spinning machine according to claim 4, wherein said adjusting means extends along the axial direction of said winding drum and has a plurality of said guide surfaces disposed along the longitudinal direction thereof.

7. An open-end spinning machine according to claim 1, wherein each said compensating means comprises at least two curved plates mounted at a position in front of said traversing means, each of said curved plates having at least one guide surface extending along the axial direction of said winding drum and inclined with respect to the surface of said winding drum, said guide surface being adjacent each other with the angles of inclination of said guide surfaces being determined by the conical angle of said conical cheese, said adjusting means comprising means for displacing at least one of said curved plates transversely so that said determined guide surface is adjusted by varying the composite guide surface formed by said adjacent guide surfaces to correspond to said predetermined conical angle of said conical cheese.

8. An open-end spinning machine according to claim 7, wherein said winding drum comprises a plurality of drive cylinders for rotating corresponding bobbins, and each of said plates has a corresponding plurality of guide surfaces, each plate having a guide surface for each of said bobbins.

9. An open-end spinning machine, comprising:

means for positively feeding a spun yarn from a spinning unit;

means for traversing said fed spun yarn in a direction perpendicular to the feeding direction of said spun yarn;

a winding drum for frictionally rotating a bobbin having a conical surface for winding said traversed yarn to form a conical cheese;

means for varying the path length of said yarn to compensate for yarn path length variations caused by the traverse motion of said spun yarn and by the conical angle of said conical cheese during winding on said bobbin, said means being disposed at a position adjacent to said spun yarn path between said feeding means and said winding drum, said compensating means having a guide surface, said guide surface extending substantially along the axial direction of said winding drum and being inclined with respect to the surface of said winding drum, the angle of inclination between said guide surface and the surfaces of said winding drum being variable; and means for adjusting said compensating means in accordance with said conical angle of said conical cheese, a swingable pin journal being provided on a first end of said compensating means, and a second end of said compensating means engaging said adjusting means.

10. An open-end spinning machine according to claim 9, wherein said guide has an arc-shaped slit formed at said second end thereof, and said adjusting means is movable substantially along the axial direction of said winding drum and has a pin mounted thereon for engaging said arc-shaped slit.

11. An open-end spinning machine according to claim 9, wherein said adjusting means is connected to said second end of said guide with a connecting link and is movable substantially along the axial direction of said winding drum.

12. An open-end spinning machine according to claim 9, where said adjusting means is a rotatable cam with which said second end of said guide is engaged.

* * * * *

UNITED STATES PATENT OFFICE

CERTIFICATE OF CORRECTION

Patent No. 4,149,678 Dated April 17, 1979

Inventor(s) Tsutomu Miyazaki, et al

It is certified that error appears in the above-identified patent and that said Letters Patent are hereby corrected as shown below:

Figure 7 of the drawings should appear as shown on the attached sheet.

Column 1, line 19: "concical" should be --conical--.

Column 4, line 56: "above-mehtioned" should be --above-mentioned--.

Column 11, line 63: "compen-" should be cancelled.

lines 64, 65, 66, 67 & 68 through Column 12, line 2: These lines should be cancelled and the following inserted --yarn processing units, respectively;

compensating means disposed adjacent each spun yarn path between said feeding means and said winding drums, respectively, for varying the path lengths of said yarns to compensate for yarn path length variations caused by

UNITED STATES PATENT OFFICE
CERTIFICATE OF CORRECTION

Patent No. 4,149,678 Dated April 17, 1979

Inventor(s) Tsutomu Miyazaki, et al

It is certified that error appears in the above-identified patent and that said Letters Patent are hereby corrected as shown below:

the traverse motion of said spun yarns and by the conical angle of said conical cheeses during winding on said bobbins;--.

Signed and Sealed this

*Twenty-third* Day of *October 1979*

[SEAL]

*Attest:*

RUTH C. MASON
*Attesting Officer*

LUTRELLE F. PARKER
*Acting Commissioner of Patents and Trademarks*